US011576489B1

(12) United States Patent
Ke

(10) Patent No.: US 11,576,489 B1
(45) Date of Patent: Feb. 14, 2023

(54) SHELF STRUCTURE

(71) Applicant: Chia-Nan Ke, Changhua (TW)

(72) Inventor: Chia-Nan Ke, Changhua (TW)

( * ) Notice: Subject to any disclaimer, the term of this patent is extended or adjusted under 35 U.S.C. 154(b) by 0 days.

(21) Appl. No.: 17/489,060

(22) Filed: Sep. 29, 2021

(51) Int. Cl.

| | |
|---|---|
| ***A47B 96/02*** | (2006.01) |
| ***A47B 47/00*** | (2006.01) |
| *A47B 57/54* | (2006.01) |
| *A47B 57/34* | (2006.01) |

(52) U.S. Cl.
CPC ..... *A47B 96/021* (2013.01); *A47B 47/0083* (2013.01); *A47B 96/02* (2013.01); *A47B 57/34* (2013.01); *A47B 57/545* (2013.01)

(58) Field of Classification Search
CPC ..... A47B 96/02; A47B 96/021; A47B 96/024; A47B 96/1441; A47B 47/00; A47B 47/024; A47B 47/0083; A47B 57/545; A47B 57/34
See application file for complete search history.

(56) References Cited

U.S. PATENT DOCUMENTS 3,762,344 A * 10/1973 Chez ..... B65D 19/0026 108/57.29
4,444,125 A * 4/1984 Welsch ..... A47B 13/021 248/188
9,854,906 B1 * 1/2018 Ke ..... A47B 57/265
10,603,749 B2 * 3/2020 Cheng ..... B23K 13/043
11,096,486 B1 8/2021 Ke
11,337,522 B2 * 5/2022 Cao ..... A47B 96/021
2016/0120313 A1 * 5/2016 Tang ..... A47B 47/0091 211/134
2016/0183682 A1 * 6/2016 Tang ..... A47B 96/021 211/134
2018/0372136 A1 * 12/2018 Cheng ..... A47B 57/34
2019/0126412 A1 * 5/2019 Cheng ..... B23K 20/22

OTHER PUBLICATIONS

Chia-Nan Ke, U.S. Appl. No. 16/992,069, filed Aug. 12, 2020.

* cited by examiner

*Primary Examiner* — Kimberley S Wright

(57) ABSTRACT

A shelf structure has a frame member, a layer member and at least one reinforcement board. An outer surface of the frame member has a plurality of parallel ribs and an inner surface of frame member has a contacting face between each two ribs. An upper end and a lower end of the frame member respectively has an upper portion and a lower portion parallel with each other. A lower surface of the upper portion has at least one protruding rib. The lower portion is smaller than the upper portion. The layer member is assembled in the frame member and overlaps the upper portion of the frame member. The reinforcement board has a length equal and parallel to two opposite sides of the frame member and secured to the other two opposite side of the frame member.

18 Claims, 11 Drawing Sheets

SHELF STRUCTURE

BACKGROUND OF INVENTION

Field of Invention

The present invention relates to a shelf, and more particularly to a reinforced shelf structure.

Description of the Related Art

The conventional storage shelf structure, please refer to FIGS. 10 and 11 10 and 11. The storage shelf 20 includes a frame member 21 and a shelf 22. The inner surface of the frame member 21 is provided with a fitting convex surface. 211, and all of the upper and lower end edges of the four sides of the frame member 21 have parallel horizontal ribs 212. Moreover, a lip 213 is at the end of the horizontal rib 212 on the upper end edge, two sides of the horizontal ribs 212 are not connected and are respectively bent at each corner of the frame member 21 to form a concave arc groove 214. The concave arc groove 214 has an assembly arc board 215, and the shelf 22 is accommodated in the frame member 21 and connected to the lip 213 of the horizontal rib 212 at the upper edge of the frame member 21. At least one reinforcing rib 23 is provided inside the frame member 21, and the reinforcing rib 23 is connected and fixed to the two parallel sides of the frame member.

The above-mentioned conventional structure still has some shortcomings. The main reasons are as follows: the conventional storage shelf 22 is fixed to the lip 213 of the lower surface of the horizontal rib 212 of the frame member 21, and the bonding area depends on the width of the lip 213, but since the lip 213 is designed to shield the sharp edge of the horizontal rib 212 to avoid injure, the area for the joint assembly of the protective lip 213 and the shelf 22 is insufficient. Although the frame member 21 is provided with a reinforcing rib 23, the thickness of the reinforcing rib 23 is still insufficient, and the reinforcing support cannot be effectively achieved.

Therefore, it is desirable to provide a shelf structure to mitigate and/or obviate the aforementioned problems.

SUMMARY OF THE INVENTION

An objective of present invention is to provide a shelf structure.

To achieve these and other objects of the present invention, a shelf structure has a frame member, a layer member and at least one reinforcement board. An outer surface of the frame member has a plurality of parallel ribs and an inner surface of frame member has a contacting face between each two ribs, an upper end and a lower end of the frame member respectively has an upper portion and a lower portion parallel with each other. A lower surface of the upper portion has at least one protruding rib. The lower portion is smaller than the upper portion. The layer member is assembled in the frame member and overlaps the upper portion of the frame member. The reinforcement board has a length equal and parallel to two opposite sides of the frame member and secured to the other two opposite side of the frame member. An upper end and a lower end of the reinforcement board respectively has an upper trim and a lower trim. An upper surface of the upper trim has at least one reinforcement protruding rib, the upper trim and the upper portion of the frame member sandwich the layer member, and the reinforcement rib and the protruding rib is connected to the layer member.

Other objects, advantages, and novel features of invention will become more apparent from the following detailed description when taken in conjunction with the accompanying drawings.

DETAILED DESCRIPTION OF THE PREFERRED EMBODIMENT

Figure 1:
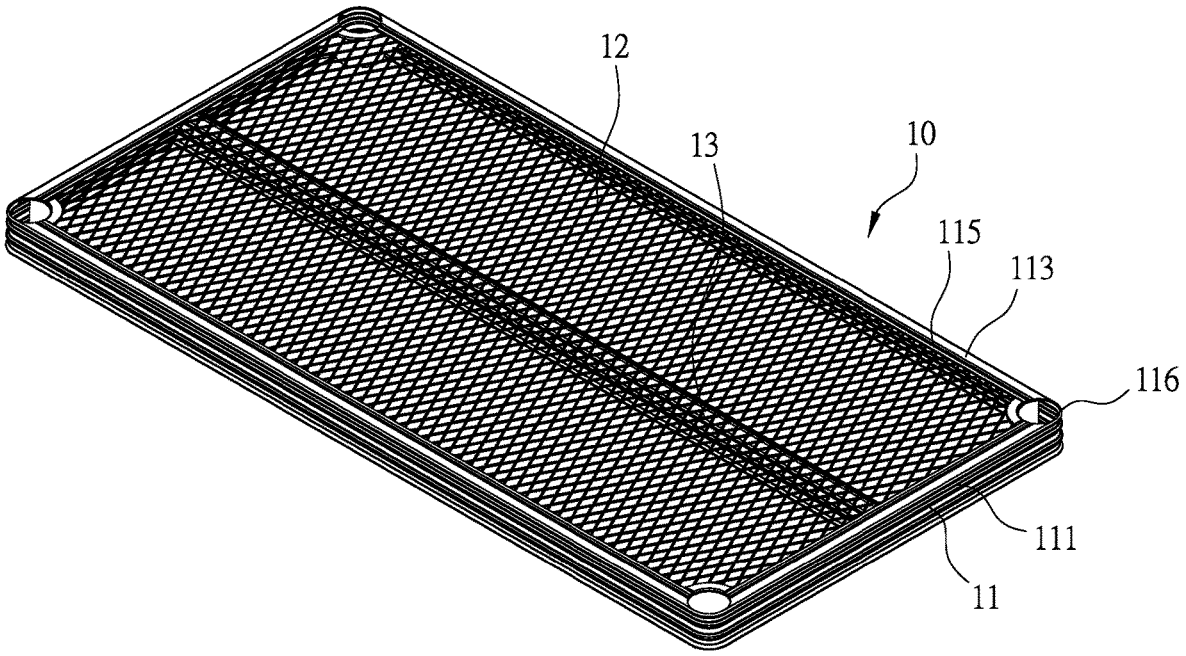
FIG. 1 is a perspective view of a preferred embodiment according to the present invention.
Figure 2:
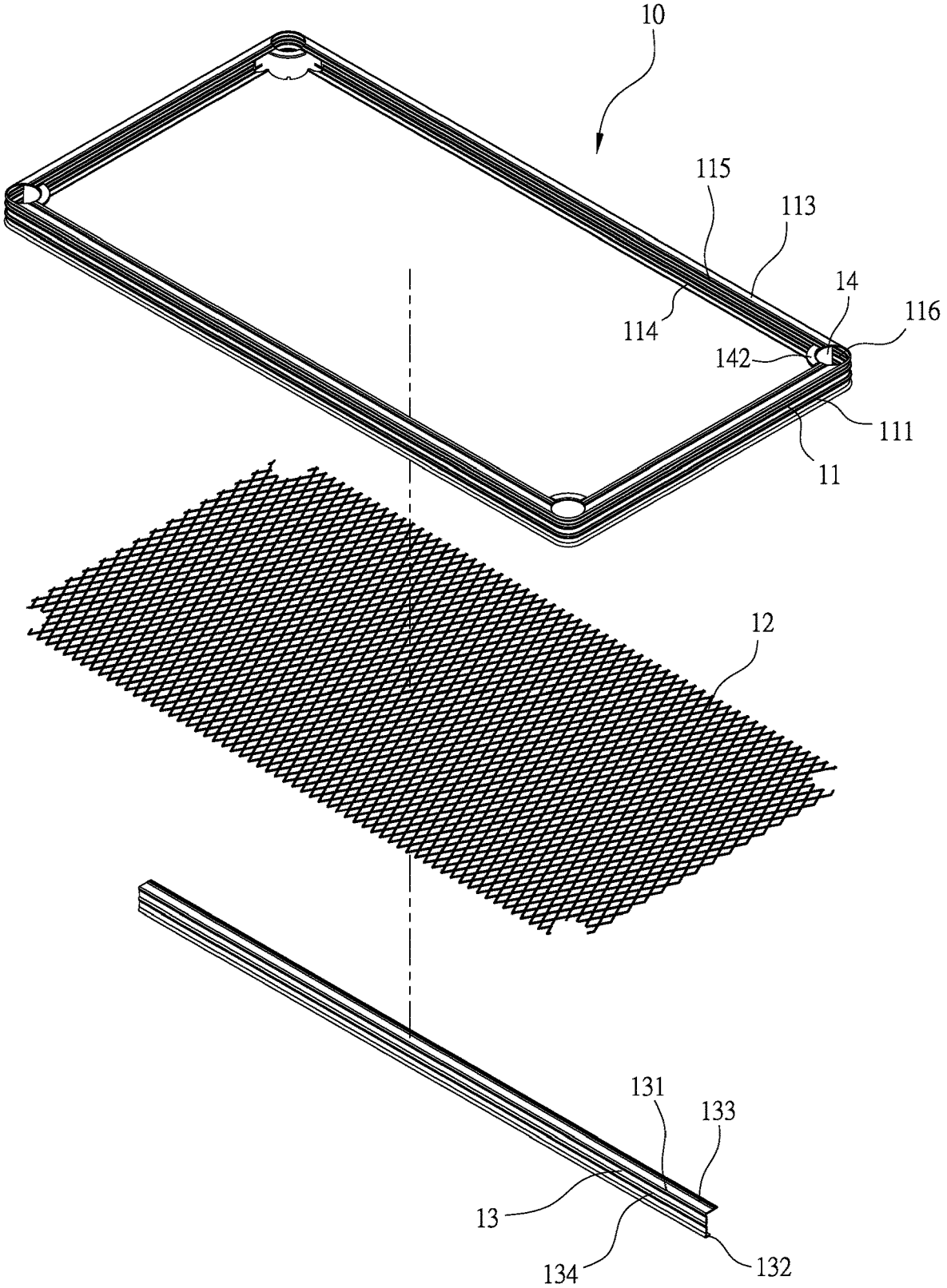
FIG. 2 is an exploded view of the preferred embodiment according to the present invention.
Figure 3:
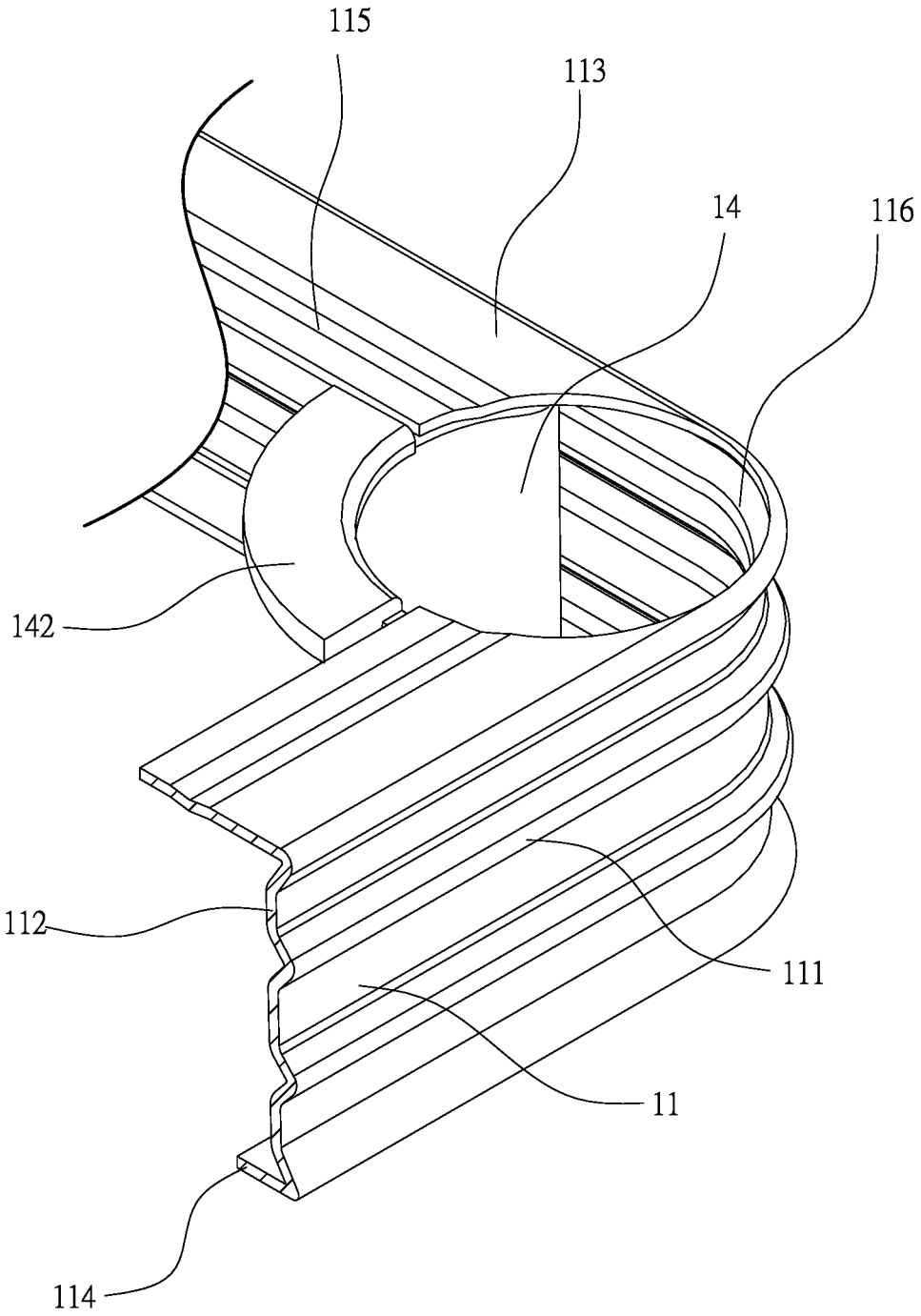
FIG. 3 is a partial enlarged drawing of the frame member of the preferred embodiment according to the present invention.
Figure 4:
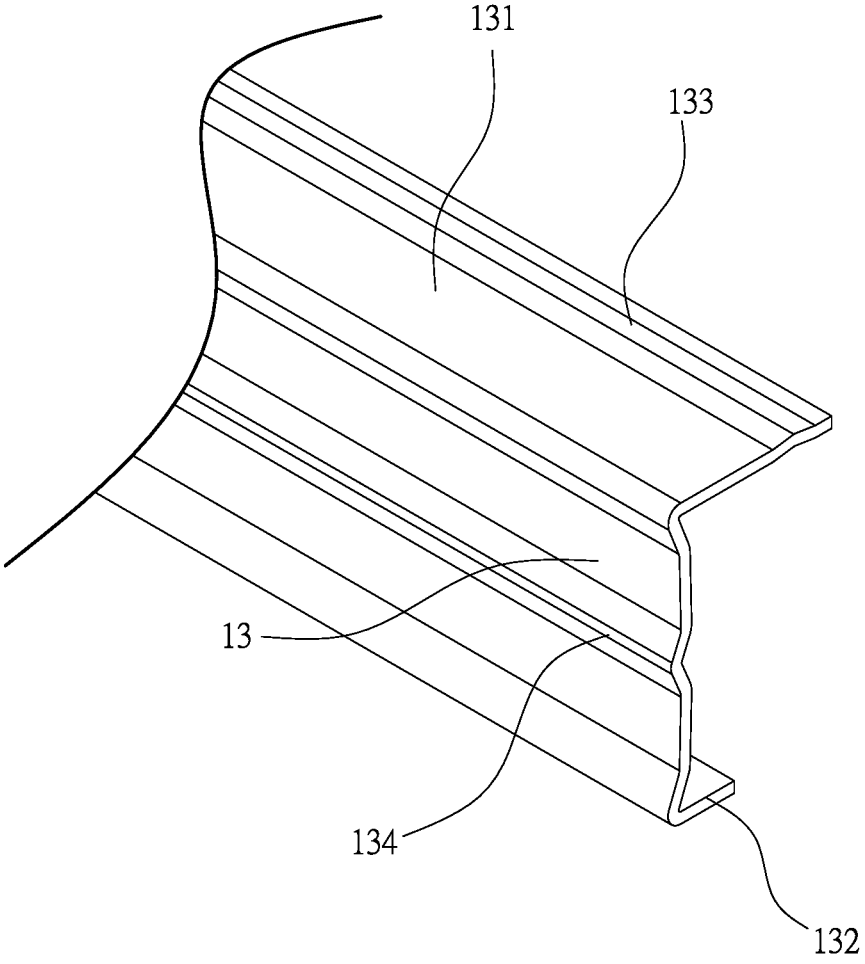
FIG. 4 is a partial enlarged schematic drawing of the reinforcement board of the preferred embodiment according to the present invention.
Figure 5:
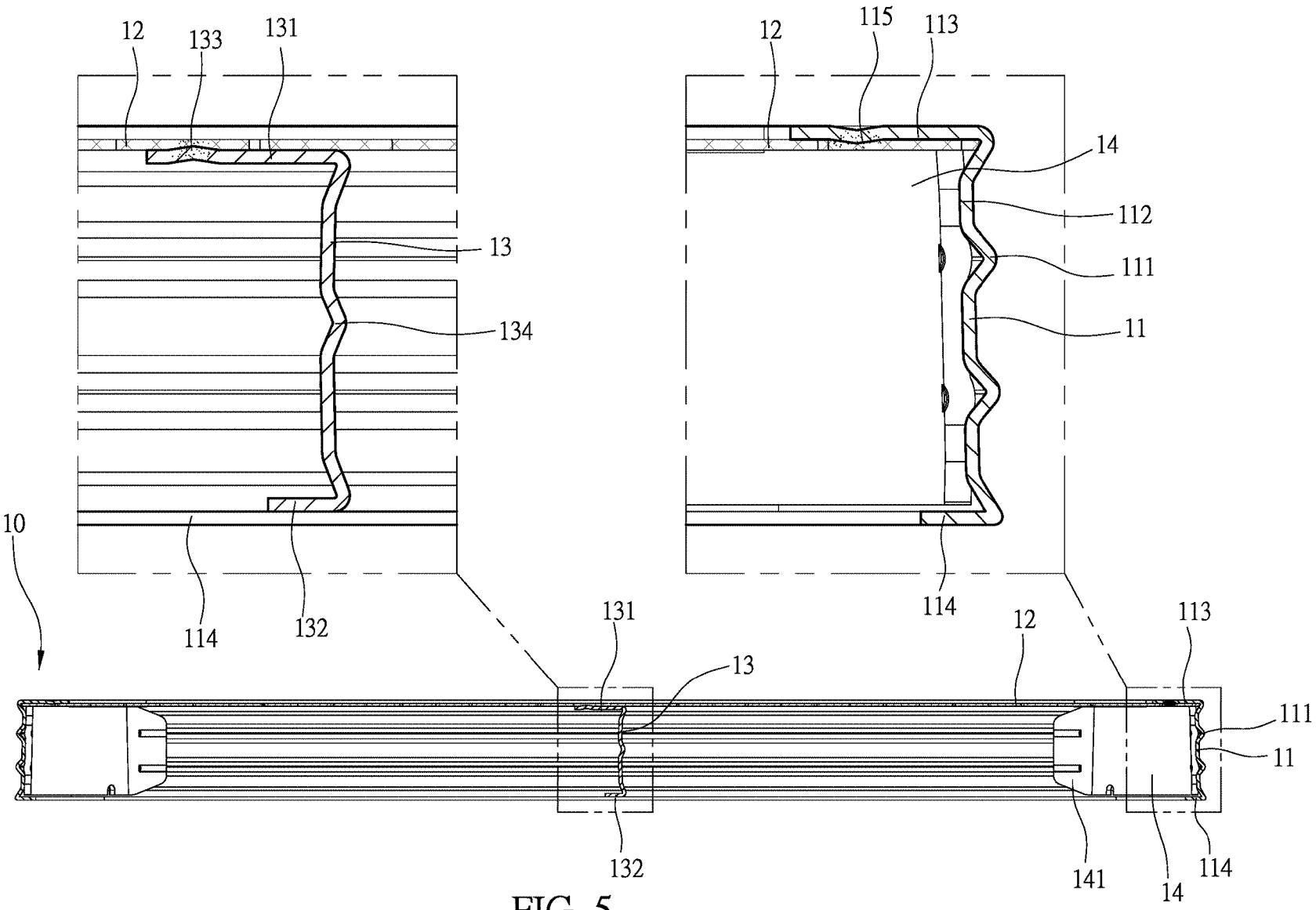
FIG. 5 is a combined cross-sectional view and partial enlarged schematic drawing of the preferred embodiment according to the present invention.

First, please refer to FIGS. 1-4. A shelf structure 10 comprises a frame member 11, a layer member 12 and at least one reinforcement board 13. An outer surface of the frame member 11 has a plurality of parallel ribs 111, and an inner surface of frame member 11 has a contacting face 112 between each two ribs 111. An upper end and a lower end of the frame member 11 respectively have an upper portion 113 and a lower portion 114 parallel with each other. A lower surface of the upper portion 113 has at least one protruding rib 115. The lower portion 114 is smaller than the upper portion 113. The layer member 12 is assembled in the frame member 11 and overlapping the upper portion 113 of the frame member 11. The reinforcement board 13 has a length equal and parallel to two opposite sides of the frame member 11 and is secured to the other two opposite side of the frame member 11. An upper end and a lower end of the reinforcement board 13 respectively have an upper trim 131 and a lower trim 132, an upper surface of the upper trim has at least one reinforcement protruding rib 133. The upper trim 131 and the upper portion 113 of the frame member 11 sandwiches the layer member, and the reinforcement rib 13 and the protruding rib 133 are connected to the layer member 12. The upper portion 113 and the lower portion 114 of the frame member 11 are not connected and respectively bent as a concave arc groove 116 at each corner of the frame member 11. Each of the concave arc grooves 116 is assembled with an assembly arc board 14 facing the concave arc groove 116, and two ends of each assembly arc board 14 respectively have a wing 141 and an upper edge of each assembly arc board 14 has a stopping plate 142.

For the assembly of the shelf structure, as shown in FIGS. 1-5, the frame member 11 is a rectangular frame member, an arc section of the assembly arc board 14 faces the concave arc groove 116, and the two wings 141 of the assembly arc board 14 are secured to the contacting face 112 of the frame member 11. Therefore, each of the concave arc groove 116 and the corresponding assembly arc board 14 form a socket, and the layer member 12 is assembled in the frame member 11 and pushes against the upper portion 113 of the frame member 11. Both of the reinforcement board 13 and the frame member 11 have two long parallel sides with equal lengths corresponding to each other, and the reinforcement board 13 is assembled in the frame member 11 and secured with two short sides of the frame member 11. The upper trim 131 of the reinforcement board 13 and the upper portion 113 of the frame member 11 sandwich and position the layer member 12, and the lower trim 132 of the reinforcement board 13 overlapped the lower portion 114 of the frame member 11. Afterward, the reinforcement protruding rib 133 of the upper trim 131 and the protruding rib 115 of the upper portion 113 are welded with the layer member 12.

Figure 6:
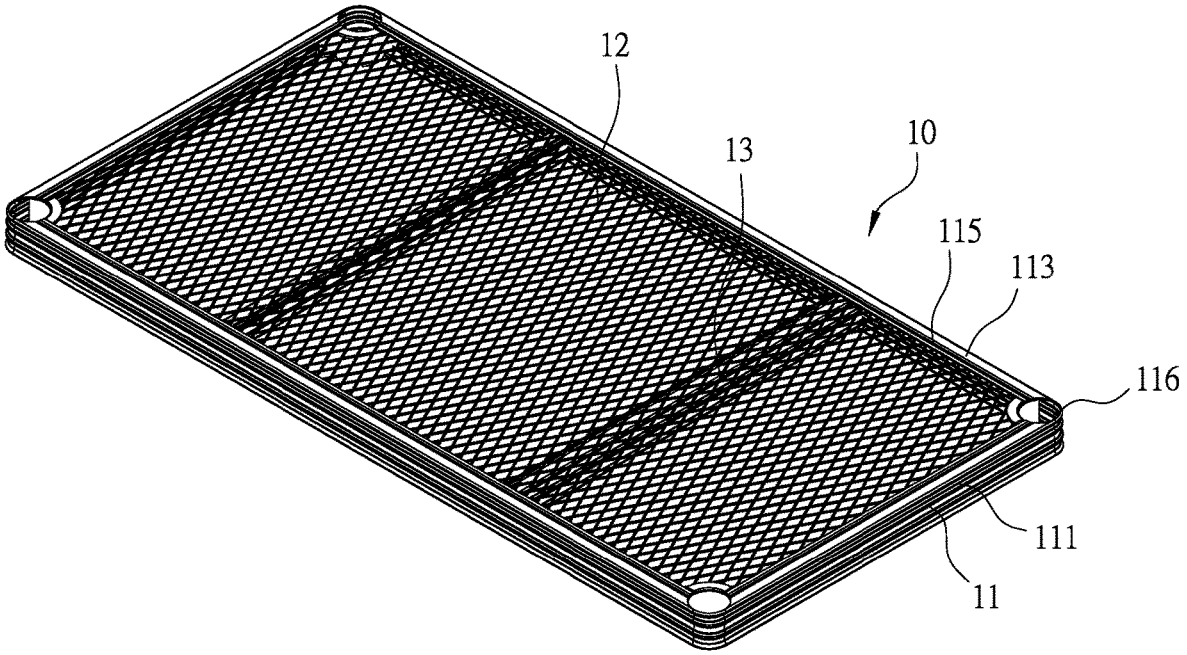
FIG. 6 is a perspective view of another embodiment of the preferred embodiment according to the present invention.

For the structure of another embodiment, as shown in FIG. 6, both of the reinforcement board 13 and the frame member 11 have two short parallel sides with equal lengths corresponding to each other, and the reinforcement board 13 is assembled in the frame member 11 and secured with two long sides of the frame member 11.

Figure 7:
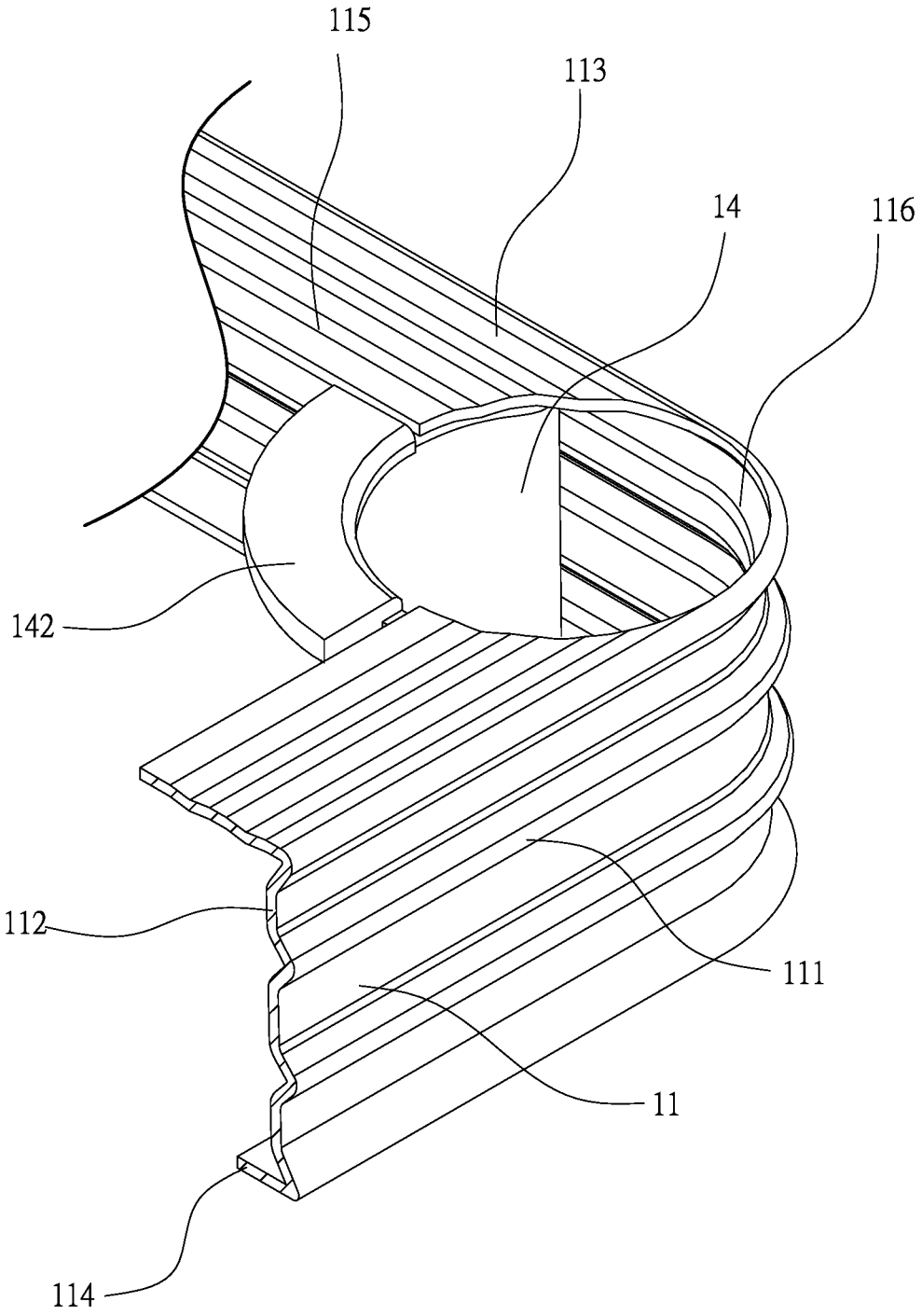
FIG. 7 is a schematic drawing of the frame member provided with a plurality of the protruding ribs on the upper portion of the preferred embodiment according to the present invention.
Figure 8:
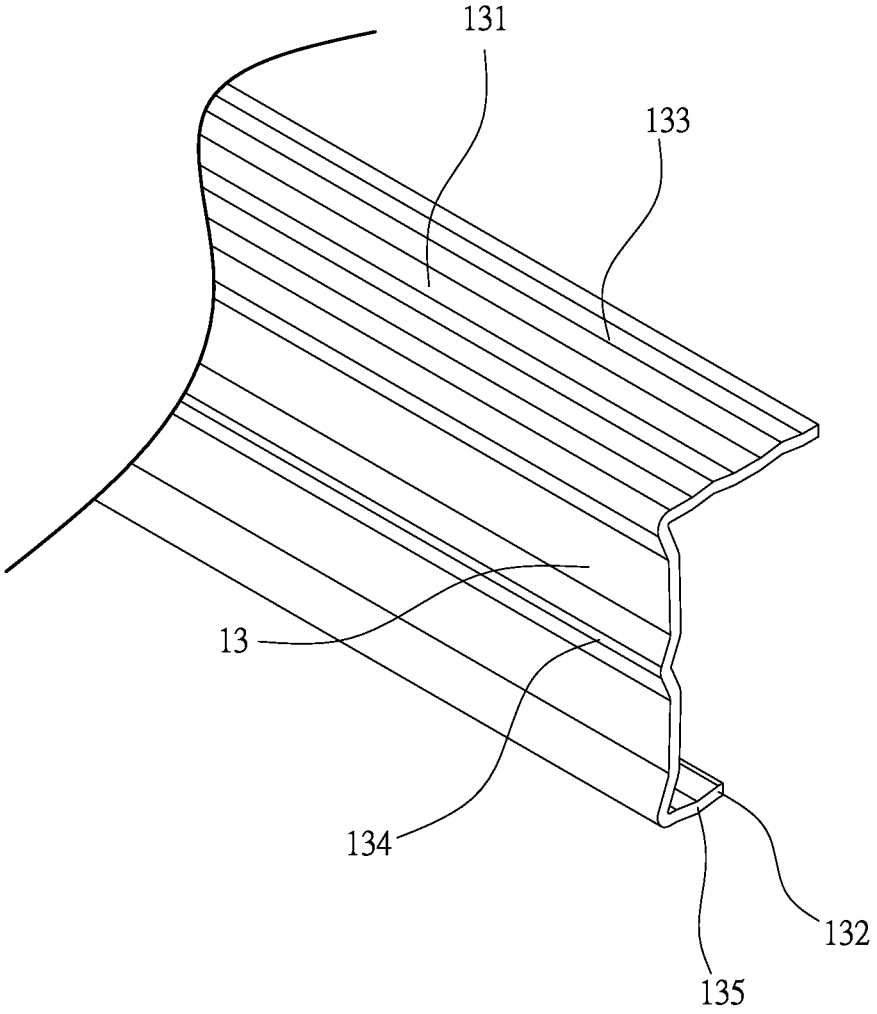
FIG. 8 is a schematic diagram of the reinforcement board the upper trim with the reinforcement protruding rib and the lower trim with a reinforcement protruding rib of the preferred embodiment according to the present invention.
Figure 9:
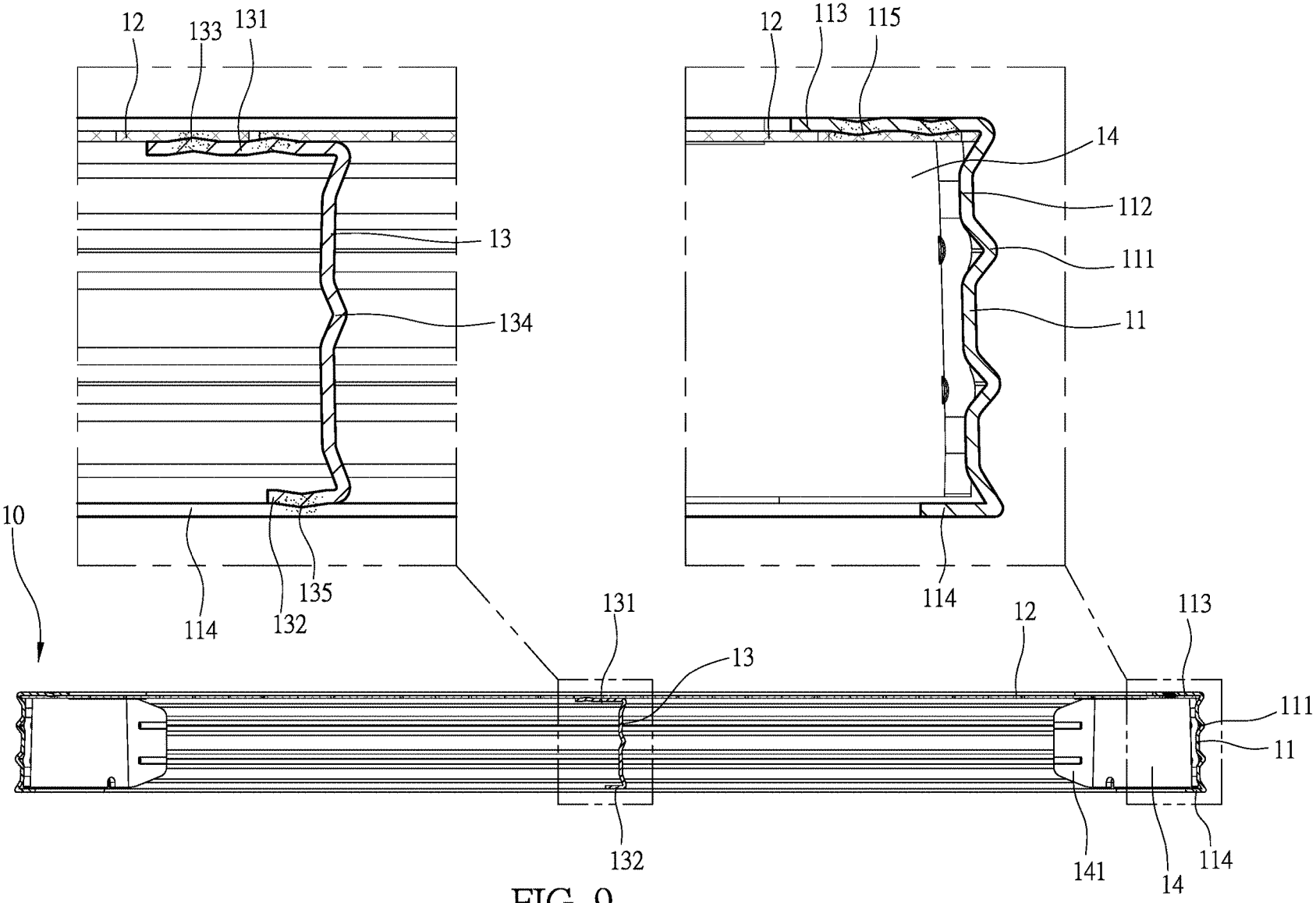
FIG. 9 is a combined cross-sectional view and partial enlarged schematic view of FIGS. 7 and 8 of the preferred embodiment according to the present invention.
Figure 10:
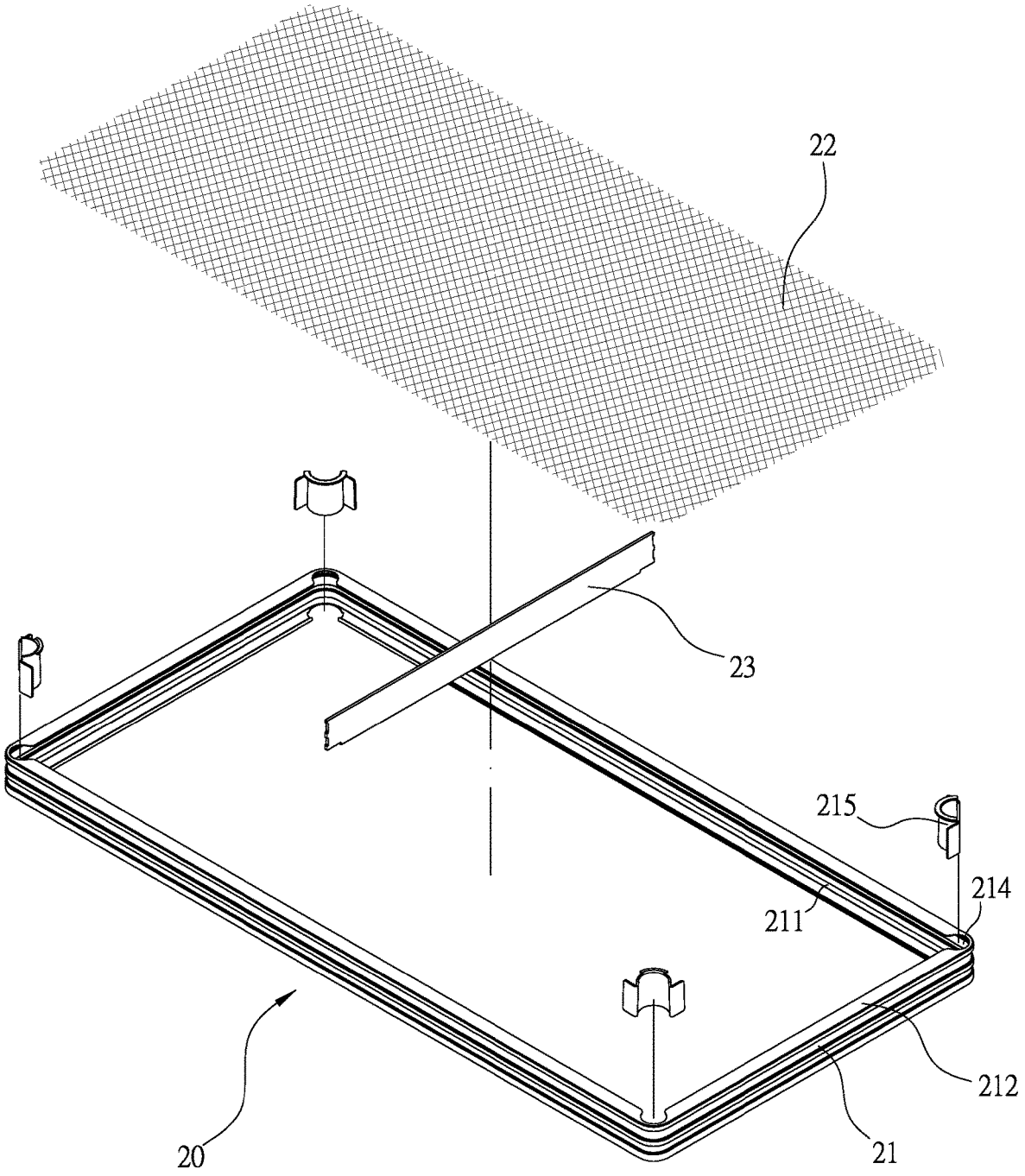
FIG. 10 PRIOR ART
FIG. 10 is an exploded view of prior art.
Figure 11:
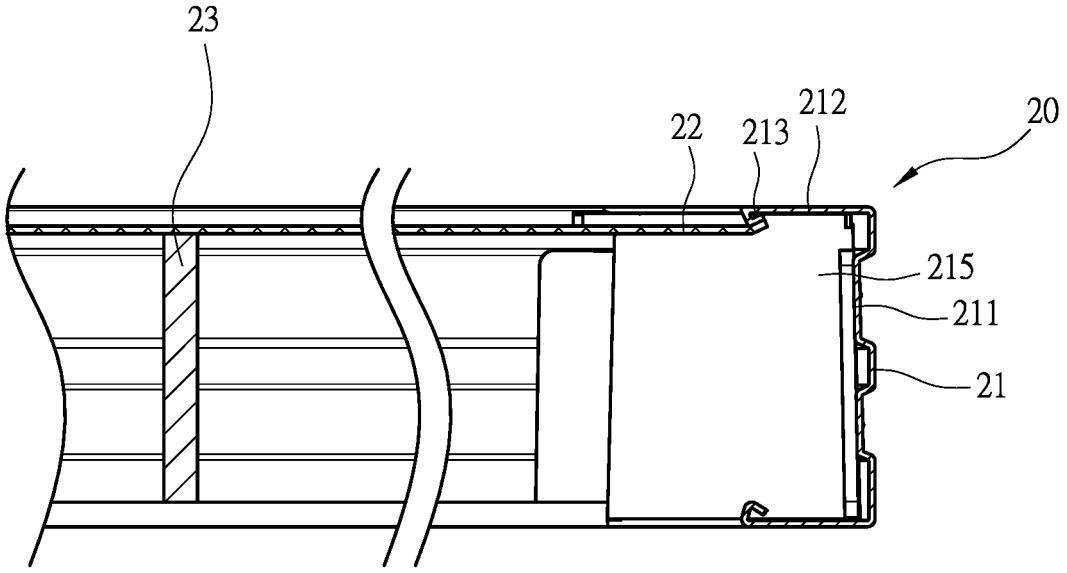
FIG. 11 PRIOR ART
FIG. 11 is a sectional view of prior art.

As shown in FIGS. 7, 8 and 9, the upper portion 113 of the frame member 11 has a plurality of parallel protruding ribs 115, and the reinforcement board 13 has at least one rib 134. Furthermore, an upper surface of the upper trim 131 of the reinforcement board 13 has a plurality of parallel reinforcement protruding ribs 133, and a lower surface of the lower trim 132 of the reinforcement board 13 further has a reinforcement protruding rib 135. When the two corresponding sides of the reinforcement board 13 and the frame member 11 are combined, the reinforcement protruding rib 135 of the lower trim 132 is spot welded to the lower portion 114 of the frame member 11 to ensure that Combination stability of the reinforcement board 13 and the frame member 11.

With the structure of the above specific embodiment, the following benefits can be obtained: when the shelf structure 10 is assembled, the upper portion 113 of the frame member 11 is used to support the layer member 12, and with the upper trim 131 of the reinforcement board 13, the protruding rib 115 of the upper portion 113 and the reinforcement protruding rib 133 of the upper trim 131 are in contact with the layer member 12 and fixed by spot welding to ensure the bonding strength between the frame members 11 and the layer member 12, which helps to improve the durability of the structure, thereby prolonging the service life of the shelf 10.

Although the present invention has been explained in relation to its preferred embodiment, it is to be understood that many other possible modifications and variations can be made without departing from the spirit and scope of invention as hereinafter claimed.

What is claimed is:

1. A shelf structure comprising:

a frame member, a layer member, and at least one reinforcement board;

wherein:

an outer surface of the frame member has plurality of parallel ribs and an inner surface of the frame member has a contacting face between each pair of ribs, an upper end and a lower end of the frame member respectively having an upper portion and a lower portion parallel with each other, a lower surface of the upper portion having at least one protruding rib;

the lower portion is smaller than the upper portion;

the layer member is assembled in the frame member and abuts the upper portion of the frame member;

the reinforcement board has a length equal and parallel to two opposing sides of the frame member and secured to two other opposing sides of the frame member;

an upper end and a lower end of the reinforcement board respectively have an upper trim and a lower trim, an upper surface of the upper trim having at least one reinforcement protruding rib, the upper trim and the upper portion of the frame member sandwiching the layer member; and the reinforcement rib and the protruding rib are connected to the layer member.

2. The shelf structure as claimed in claim 1, wherein a lower surface of the upper portion of the frame member has a plurality of parallel protruding ribs.

3. The shelf structure as claimed in claim 1, wherein an upper surface of the upper trim of the reinforcement board has a plurality of parallel reinforcement protruding ribs.

4. The shelf structure as claimed in claim 1, wherein the reinforcement board has a plurality of ribs.

5. The shelf structure as claimed in claim 1, wherein a lower surface of the lower trim of the reinforcement board further has a reinforcement protruding rib.

6. The shelf structure as claimed in claim 1, wherein the upper portion and the lower portion of the frame member are not continuous and are respectively bent as a concave arc groove at each corner of the frame member, each of the concave arc grooves is assembled with an assembly arc board facing the concave arc groove, and two ends of each assembly arc board respectively have a wing abutting the contacting face of the frame member and an upper edge of each assembly arc board has a stopping plate.

7. The shelf structure as claimed in claim 1, wherein the frame member is a rectangular frame member, both of the reinforcement board and the frame member having two long parallel sides with equal lengths corresponding to each other, and the reinforcement board is assembled in the frame member and secured with two short sides of the frame member.

8. The shelf structure as claimed in claim 7, wherein a lower surface of the upper portion of the frame member has a plurality of parallel protruding ribs.

9. The shelf structure as claimed in claim 7, wherein an upper surface of the upper trim of the reinforcement board has a plurality of parallel reinforcement protruding ribs.

10. The shelf structure as claimed in claim 7, wherein the reinforcement board has a plurality of ribs.

11. The shelf structure as claimed in claim 7, wherein a lower surface of the lower trim of the reinforcement board further has a reinforcement protruding rib.

12. The shelf structure as claimed in claim 7, wherein the upper portion and the lower portion of the frame member are not continuous and are respectively bent as a concave arc groove at each corner of the frame member, each of the concave arc grooves is assembled with an assembly arc board facing the concave arc groove, and two ends of each assembly arc board respectively have a wing abutting the contacting face of the frame member and an upper edge of each assembly arc board has a stopping plate.

13. The shelf structure as claimed in claim 1, wherein the frame member is a rectangular frame member, both of the reinforcement board and the frame member have two short parallel sides with equal lengths corresponding to each other, and the reinforcement board is assembled in the frame member and secured with two long sides of the frame member.

14. The shelf structure as claimed in claim 13, wherein a lower surface of the upper portion of the frame member has a plurality of parallel protruding ribs.

15. The shelf structure as claimed in claim 13, wherein an upper surface of the upper trim of the reinforcement board has a plurality of parallel reinforcement protruding ribs.

16. The shelf structure as claimed in claim 13, wherein the reinforcement board has a plurality of ribs.

17. The shelf structure as claimed in claim 13, wherein a lower surface of the lower trim of the reinforcement board further has a reinforcement protruding rib.

18. The shelf structure as claimed in claim 13, wherein the upper portion and the lower portion of the frame member are not continuous and are respectively bent as a concave arc groove at each corner of the frame member, each of the concave arc grooves is assembled with an assembly arc board facing the concave arc groove, and two ends of each assembly arc board respectively have a wing abutting the contacting face of the frame member and an upper edge of each assembly arc board has a stopping plate.

* * * * *